US009021514B2

(12) United States Patent
Battiston et al.

(10) Patent No.: US 9,021,514 B2
(45) Date of Patent: Apr. 28, 2015

(54) MONITORING DEVICE FOR CAPTURING AUDIENCE RESEARCH DATA

(75) Inventors: Daniel Battiston, Kirchberg (CH); Olivier Staub, Herrenschwanden (CH); Andreas Koschak, Seftigen (CH)

(73) Assignee: GFK Telecontrol AG (CH)

( * ) Notice: Subject to any disclaimer, the term of this patent is extended or adjusted under 35 U.S.C. 154(b) by 418 days.

(21) Appl. No.: 12/687,978

(22) Filed: Jan. 15, 2010

(65) Prior Publication Data

US 2010/0185495 A1 Jul. 22, 2010

(30) Foreign Application Priority Data

Jan. 16, 2009 (EP) ..... 09150784

(51) Int. Cl.

| | |
|---|---|
| ***H04H 60/33*** | (2008.01) |
| ***H04H 60/58*** | (2008.01) |
| ***H04H 60/31*** | (2008.01) |
| ***H04H 60/32*** | (2008.01) |
| ***H04H 60/37*** | (2008.01) |
| ***H04H 60/43*** | (2008.01) |
| ***H04H 60/44*** | (2008.01) |
| *H04H 20/31* | (2008.01) |

(52) U.S. Cl.

CPC ..... *H04H 60/58* (2013.01); *H04H 20/31* (2013.01); *H04H 60/31* (2013.01); *H04H 60/32* (2013.01); *H04H 60/37* (2013.01); *H04H 60/43* (2013.01); *H04H 60/44* (2013.01)

(58) Field of Classification Search

None

See application file for complete search history.

(56) References Cited

U.S. PATENT DOCUMENTS

| | | | | |
|---|---|---|---|---|
| 5,481,294 | A * | 1/1996 | Thomas et al. | 725/20 |
| 5,608,445 | A | 3/1997 | Mischler | |
| 6,286,140 | B1 | 9/2001 | Ivanyi | |
| 2007/0136782 | A1 * | 6/2007 | Ramaswamy et al. | 725/138 |
| 2007/0192803 | A1 | 8/2007 | Chisaka | |
| 2009/0249387 | A1 * | 10/2009 | Magdy et al. | 725/32 |

FOREIGN PATENT DOCUMENTS

| | | | |
|---|---|---|---|
| DE | 37 42 426 | A1 | 6/1989 |
| EP | 0 665 690 | A1 | 8/1995 |
| EP | 0 665 690 | B1 | 5/1996 |
| EP | 0 887 958 | A1 | 12/1998 |
| FR | 2 717 025 | A1 | 9/1995 |
| FR | 2 717 025 | A1 | 11/1995 |
| WO | WO 94/11989 | A1 | 5/1994 |
| WO | WO 94/17609 | A1 | 8/1994 |
| WO | WO 2006/020560 | A2 | 2/2006 |

OTHER PUBLICATIONS

European Search report dated Nov. 26, 2009, issued in corresponding European priority application No. EP 09150784.

European Examination Report dated Sep. 22, 2014 in corresponding European Patent Application No. 09 150 784.8 (English language).

* cited by examiner

*Primary Examiner* — Mark D Featherstone

(74) *Attorney, Agent, or Firm* — Ostrolenk Fabe LLP

(57) ABSTRACT

A monitoring device (1) comprising a basic set of audience research data retrieval units (7, 9) which are compatible with a broad range of AV appliances reproducing AV contents like TV sets (3). The data retrieval units are a audio watermark retrieval unit (9) and an audio signal sampling unit (7). For easy adaptation to particular AV installation, the monitoring device (1) is provided with internal and external connectors so that specialized modules can be integrated.

4 Claims, 2 Drawing Sheets

MONITORING DEVICE FOR CAPTURING AUDIENCE RESEARCH DATA

Figure 1:
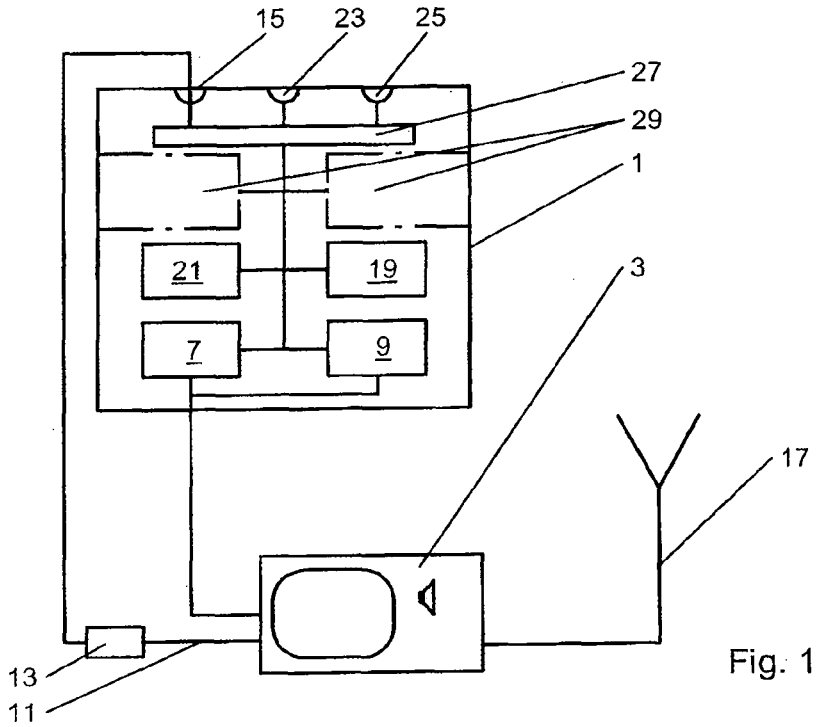

The present invention relates to a monitoring device for capturing audio research data.

Monitoring devices for capturing audience research data are coupled to AV (audio/video) installations. They watch the operational status of the individual appliances and by means of appropriate sensing means, detect which programs or AV media are presented to an audience, preferably without any human interaction. These monitors are usually installed in the households of panelists. Depending on the applied detection method, similar devices have to be installed at reference locations in order to get reference data of the programs.

AV installations may comprise a manifold of different appliances, starting with a TV set, tuner, magnetic tape recorder, DVD recorder and player. These appliances are based on very differing techniques, just to mention that TV sets and TV tuners may be digital or analog. Still, a PC (personal computer) may serve as an AV appliance, either on its own or in cooperation with conventional AV appliances.

Due to the continuing development in the AV domain producing an increasing variety of AV appliances, a standard monitoring device for audience research can no more cope with any AV environment.

Therefore, an object of the present invention is to propose a monitoring device which is usable in many different AV installations.

Such a monitoring device is arranged for watching the activity of a household AV installation and comprises:

- an audio sampling means for taking samples of an audio signal output by an AV appliance and storing them;
- a code extraction means for detecting a code in the audio signal and storing the code or data derived from the code;
- connector means for providing the monitoring device with means capable to retrieve additional data of or from the AV appliance;
- a data management portion operably connected to the aforementioned components so that it is capable to receive data therefrom and to store the data.

Accordingly, the monitoring device comprises a data management including a memory, data transmission means, a basic set of AV monitoring means, and a set of connectors capable to receive or attach to modules which perform other AV monitoring techniques.

As the basic set of AV monitoring means, an audio sampling and compression portion and a code extracting portion are implemented. The code if present is embedded in the audio signal as well. By choosing audio watching means as the components of the basic set, the monitoring device is already provided with an almost universal capability to furnish data which either by themselves (in the case of ancillary codes), either by correlation with data simultaneously captured on reference sites, allow to identify the viewed or heard program or medium.

By providing connectors for attaching modules, the monitor can be provided with survey facilities allowing easier or faster recognition of AV media, detection of peculiar conditions, or even to capture needed data at all in case the basic set is unable to perform the task.

The invention shall be further described by a preferred exemplary embodiment with reference to the Figures.

Figure 2:
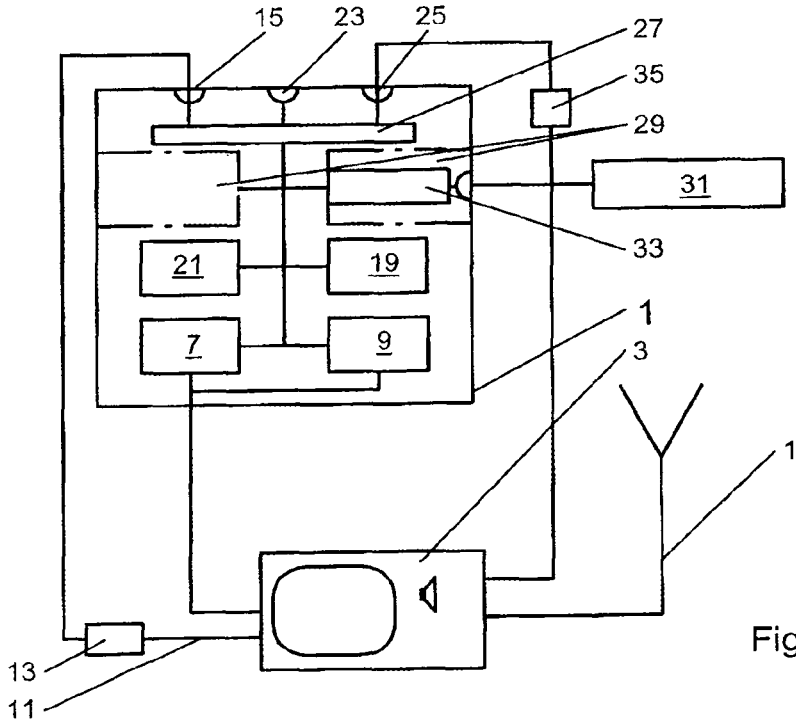

FIG. 1 A first AV survey configuration;

FIG. 2 a second AV survey configuration; and

Figure 3:
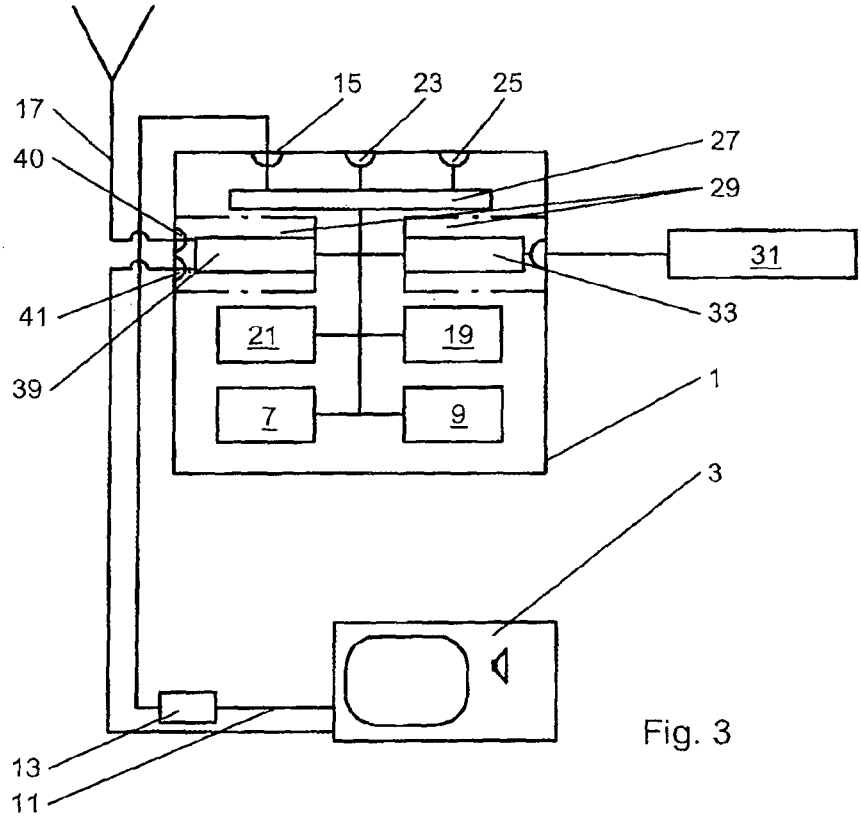

FIG. 3 a third AV survey configuration.

FIG. 1 shows a monitoring device 1 according to the invention connected to a TV set 3 by an audio line 5. The audio line 5 is connected to an audio output of the TV set 3 or takes the sound of the loudspeaker of the TV set by means of a microphone (not shown). On the side of the monitoring device 1, the audio line 5 is internally connected to the audio sampling unit 7 and the audio code extractor 9. The sampling unit 7 takes samples of the audio signal, highly compresses and stores them for later correlation with reference samples. One such technique is described in detail in EP-A-0 887 958 of the applicant, which is incorporated by reference hereby.

The code extractor 9 determines if a code is embedded in the audio signal, and extracts it. Such a code may be present as a so-called watermark which is completely imperceptible by the audience.

As the code usually contains all necessary data, the code extractor 9 may inhibit the audio samples unit 7, so that only the code is stored.

A further on/off sensing line 11 is connected to the TV set. The on/off sensor 13 decides in dependence on the status of the sensing line 11 if the TV set is switched on. The sensing line may be connected to any connector accessible at the TV set and bearing a kind of supply or signal voltage. An alternative is to provide a current sensor between TV set and mains (not shown), and the output of the current sensor is the sense line 11. A third possibility is to detect presence of a video signal on an output of the TV set, and/or an audio signal, the presence of one of which is indicative that the TV set is on.

Due to the different possibilities, the on/off sensor is an external device connected to one of the extension connection 15.

In this example, the TV set receives the programs via an aerial 17.

The monitoring device 1 further comprises:

- The data management unit 19 including also the required memory; the memory keeps the survey data until they are transferred to the evaluation center.
- The data transmission unit 20: It handles data transmission from and to the monitoring device. Outgoing data contain mainly the retrieval audience survey data. Incoming data may be a remote management command, program related data, questions to be posed to the panelist, etc. Data communication is preferably performed online, i.e. by a wireless phone interface, a digital or analog modem, or an access to the internet via a LAN or WLAN.
- Externally accessible connectors 15, 23, 25 serve different purposes: Connection of an external data retrieval unit like the already mentioned on/off detector; connection to the Internet, to phone line, LAN, attachment of extension cards like a wireless modem PC card (formerly known as PCMCIA card). The number of connectors shown is only illustrative.
- A suitable driver and control unit 27 for managing the externally accessible connectors.
- Internal connectors 29 for inserting and connecting additional modules to the monitor 1.

FIG. 2 shows mainly the same arrangement as FIG. 1, yet there is additionally present an IP box 31. An IP box receives AV programs via a fast Internet access. Usually, an IP box further contains an internal mass storage so that reproduction on an AV appliance like a TV set may be time-shifted or repeated. For detecting peculiar conditions of the IP box 31, video signals of the IP box 31 are as well furnished to the IP box analyser module 33 (IPB-AM) inserted in the monitoring device 1. The IPB-AM 33 is configured for the IP box to check peculiar areas of the video signal if graphics indicative for a menu created by the IP box 31 appear. If this is the case, the display of the menu is analysed in order to retrieve data indicating selections made by the panelist. Overall, the IPB-AM 33 results allow to discern between viewing and IP box menu operation and to measure which channel is selected.

As the TV set now receives signals from two sources, namely the aerial 17 and the IP box 31, it has to be determined of which of them originate the audio signals received by the audio watching units 7, 9: An audio recognition device 35 inserts an imperceptible signal into the audio signal furnished by the IP box 31 to the TV set 3. The signal insertion is controlled by the monitoring device 1, or the audio recognition device 35 provides an appropriate signal to the monitoring device through line 37 attached to connector 25.

If the audio watching units 7, 9 detect presence of the inserted signal in the audio output of the TV set, the TV set reproduces the AV signals from the IP box 31.

FIG. 3 shows a situation where the tuner of the TV set 3 is substituted by a tuner module 39, and even the AV output signals of the IP box 31 are forwarded through the internal connections to output 41 of the tuner 39. The aerial 17 is connected to the aerial input 40 of the tuner module 39. The tuner's output, like that of the IP box 31, consists of audio and video signals, and the TV set 3 only acts as an AV reproduction device. Therefore, no further connections to the TV set 3 are necessary, and all signals, even the audio signals for the audio analyser units 7, 9 are internally available. Channel selection and AV source selection are performed by the monitoring device 1, usually by a remote control.

All the data retrieved by the monitoring device 1 are stored by the data management unit 19 and from time to time transferred to an evaluation center by the data transmission unit 21. The data management unit 19 adds to the data unique time stamps or data and time indications. E.g. in the case of codes which comprise time indication of their generation, comparison with the time added by the monitoring device 1 allows to decide if the reproduction took place in real time or later, (time-shifted are replay of recorded material).

On the basis of the description set forth above, the one skilled in the art may derive alterations and extensions without leaving the scope of protection which is solely defined by the claims.

F.i., the following modifications are conceivable:

- USB or other connectors are provided to connect portable audience research monitors. The data of the monitors are stored by the monitoring device and forwarded to the evaluation center.
- A display is present, so that a communication between the audience and the monitoring device is possible. The display may be used to pose questions, which are answered by means of the remote control.
- A module for locally inserting a signal in program signals received by a TV set, e.g. as described in EP-A-0 665 690, incorporated herein by reference.
- A module for locally inserting a fingerprint code in an AV signal in order recognize the signal if it has been recorded by a (VCR, DVD) recorder and is played back later on.
- A detector for signals of a remote control of the AV installation is present. If a remote control activity is detected, the respective AV appliance is watched for a change in its operation. E.g. the audio watching is activated to more closely monitor the appliance, in particular to take more often samples.
- A specially adapted AV receiver means is connected to the monitoring device. The AV receiver means may be a so-called settop box. It is adapted to furnish data to the monitoring device about the received channel and/or program. Its AV signals are transmitted either directly to the AV appliance, or via the monitoring device as described for the IP box.

Glossary

AV Audio/Video

USB Universal Serial Bus

IPB-AM IP box analyser module

The invention claimed is:

1. A monitoring device for capturing audience research data arranged for watching the activity of a household AV installation, wherein the monitoring device comprises:

- an audio sampler configured to take samples of an audio signal output by an AV appliance and to store them;
- a code extractor configured to extract a code in the audio signal and to store the code or data derived from the code;
- a connector configured to allow the monitoring device to retrieve additional data of or from the AV appliance;
- a data management portion operably connected to the aforementioned components configured to receive data therefrom and to store the data, and
- extension elements connected to the monitoring device via the connector, the extension elements including:
  - a signal inserter configured for locally inserting a marker signal in an AV signal input to the AV appliance, so that detection of the marker in a signal retrieved from the AV appliance is indicative of the reproduction of the AV signal;
  - an image analyzer comprising a portion for receiving a video signal, and a portion for analyzing at least one selected area of the video image constituted by the video signal for predefined patterns, and furnishing data indicative of the presence of the pattern or data represented by the pattern;
  - a TV tuner so that the tuner of a TV appliance connected to the monitoring device can be substituted, the TV tuner furnishing data indicative of its status; and
  - a fingerprint inserter configured to insert a fingerprint in an AV signal so that the AV signal can be recognized when played back later on by an AV recording appliance;
- the data furnished by the extension elements being transmitted to the data management unit through the connector.

2. The monitoring device according claim 1, wherein the monitoring device comprises a data transmission unit arranged to retrieve data stored by the data management unit and to transmit them out of the monitoring device, the data transmission unit comprising at least one of:

- a wireless data transmitter; and
- an analog or digital modem for transmission via a telephone line.

3. The monitoring device according to claim 1, wherein the monitoring device comprises a video output element and a manually operable input element.

4. The monitoring device according to claim 1, wherein the video output element is a display and the manually operable input element is a remote control, such that questions are displayable and answers receivable by the monitoring device.

* * * * *